US007072599B2

(12) United States Patent
DiRubio et al.

(10) Patent No.: US 7,072,599 B2
(45) Date of Patent: Jul. 4, 2006

(54) CONTROL SYSTEM FOR A XEROGRAPHIC TRANSFER STATION USING A BELT

(75) Inventors: Christopher A. DiRubio, Webster, NY (US); Gerald M. Fletcher, Pittsford, NY (US); Michael F. Zona, Holley, NY (US); Rachael L. McGrath, Churchville, NY (US); Bruce E. Thayer, Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/989,086

(22) Filed: Nov. 15, 2004

(65) Prior Publication Data

US 2006/0104651 A1 May 18, 2006

(51) Int. Cl.
*G03G 15/16* (2006.01)

(52) U.S. Cl. ..... 399/66; 399/101

(58) Field of Classification Search ..... None
See application file for complete search history.

(56) References Cited

U.S. PATENT DOCUMENTS

| | | | | |
|---|---|---|---|---|
| 4,407,580 | A | 10/1983 | Hashimoto et al. | 355/3 TR |
| 5,623,330 | A | 4/1997 | Ishibashi | 399/310 |
| 5,631,725 | A * | 5/1997 | Harasawa et al. | 399/66 |
| 5,930,573 | A | 7/1999 | Miyamoto et al. | 399/310 |
| 2004/0213598 | A1 * | 10/2004 | Mori et al. | 399/101 |

* cited by examiner

*Primary Examiner*—Quana Grainger
(74) *Attorney, Agent, or Firm*—R. Hutter

(57) ABSTRACT

An electrostatographic printing apparatus comprises a charge receptor, and a transfer station for transferring a toner image from the charge receptor to a sheet by providing an electric field of predetermined magnitude at a transfer zone. The transfer station includes a rotatable transfer member, with a cleaning corotron associated therewith. A control system for maintaining a constant current at the transfer zone takes into account a current supplied by the cleaning corotron. The control system can also take into account current leakages associated with the transfer member.

8 Claims, 5 Drawing Sheets

CONTROL SYSTEM FOR A XEROGRAPHIC TRANSFER STATION USING A BELT

Cross-reference is hereby made to U.S. patent application Ser. No. 10,989,085, being filed simultaneously herewith.

TECHNICAL FIELD

The present disclosure relates to a transfer station used in electrostatographic or xerographic printing.

BACKGROUND

The basic process steps of electrostatographic printing, such as xerography or ionography, are well known. Typically an electrostatic latent image is created on a charge receptor, which in a typical analog copier or "laser printer" is known as a photoreceptor. The suitably charged areas on the surface of the photoreceptor are developed with fine toner particles, creating an image with the toner particles which is transferred to a print sheet, which is typically a sheet of paper but which could conceivably be any kind of substrate, including an intermediate transfer belt. This transfer is typically carried out by the creation of a "transfer zone" of electric fields where the print sheet is in contact with, or otherwise proximate to, the photoreceptor. Devices to create this transfer zone, such as corotrons, are well known.

Another condition that is known to be useful in a transfer zone is mechanical pressure between the print sheet and the photoreceptor: a certain amount of pressure can enhance transfer efficiency, image quality and "latitude" (the range of types of paper or other substrate which can be effectively printed on). To obtain such pressure, it is known to use a "bias transfer roll," which is an electrically-biased roll urged against either a rigid photoreceptor drum or a back up roll inside a photoreceptor belt. The combination of mechanical pressure and electrical bias creates a suitable transfer zone in the nip between the bias transfer roll and the photoreceptor.

The present disclosure relates to a control system for a novel apparatus for creating suitable conditions in a transfer zone.

PRIOR ART

U.S. Pat. Nos. 4,407,580; 5,623,330; and 5,930,573 disclose designs of transfer stations using a transfer belt.

SUMMARY

According to one aspect, there is provided an electrostatographic printing apparatus, comprising an imaging surface, and a rotatable transfer member substantially in contact with the imaging surface at a transfer zone. A control system biases the transfer member at the transfer zone. An electrically biasable cleaning device is associated with the transfer member. The control system takes into account at least one of a current leakage or a bias associated with the cleaning device to obtain a desired electrical field at the transfer zone.

DETAILED DESCRIPTION

Figure 1:
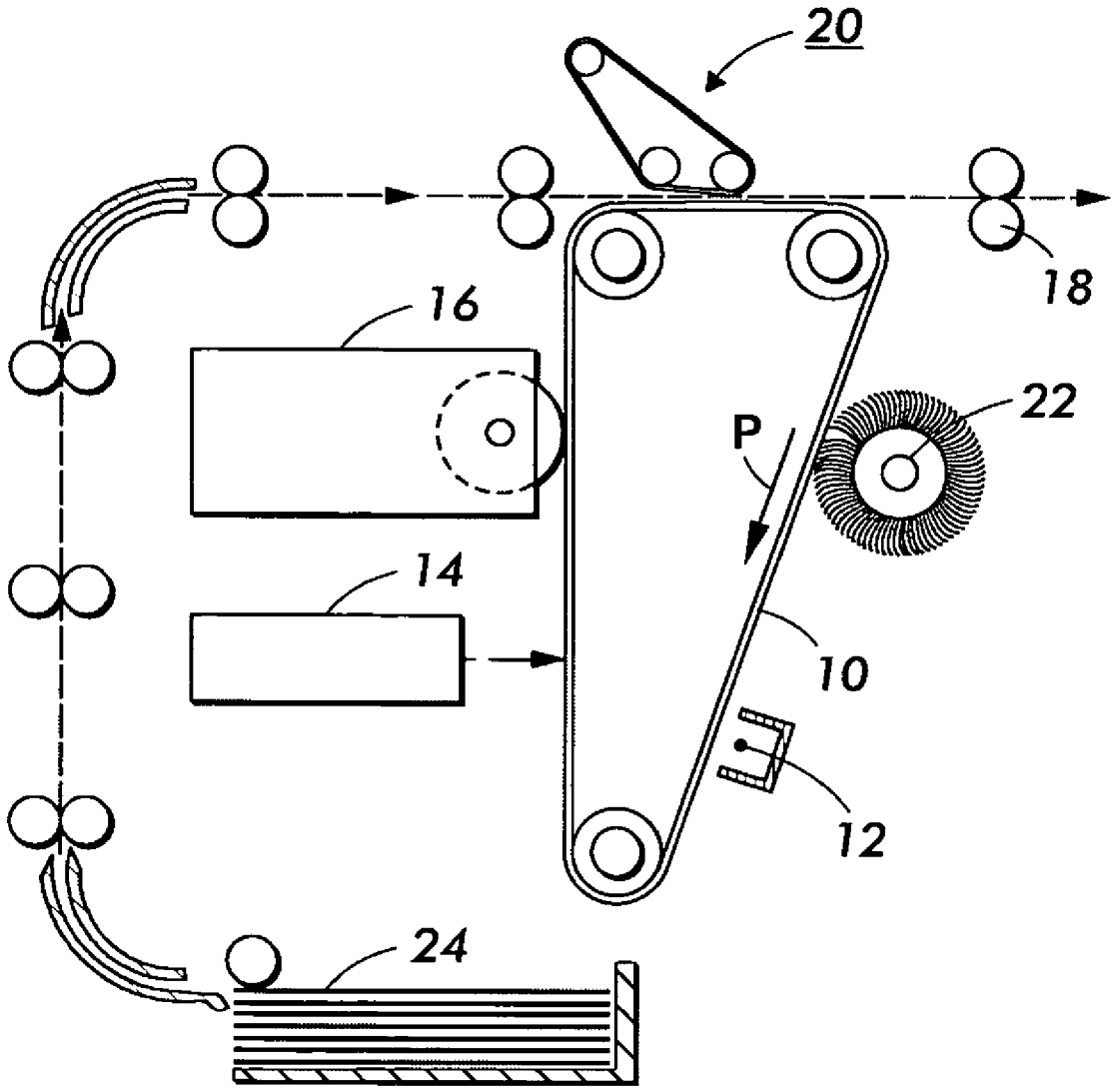
FIG. 1 is a simplified elevational diagram showing some essential elements of an electrostatographic printing apparatus, such as a printer or copier.

FIG. 1 is a simplified elevational diagram showing some essential elements of an electrostatographic printing apparatus, such as a printer or copier. As is familiar in electrostatographic printing, in particular ionography or xerography, electrostatic latent images are created on the surface of a charge receptor forming an imaging surface, such as the photoreceptor indicated as 10. As is generally familiar in xerography, there is further included a charge corotron 12 for initially uniformly charging the surface of photoreceptor 10; an exposure device 14, such as including a laser or an LED printbar, for discharging portions of the surface of photoreceptor 10 to yield a desired electrostatic latent image; a development unit 16, for causing toner particles to attach to suitably charged image areas on the surface of photoreceptor 10; and a transfer station 20, as will be discussed below. Downstream of transfer station 20 is a fusing apparatus 18 for fixing toner particles onto a print sheet to yield a permanent image. Any toner particles remaining on the photoreceptor after transfer are removed by cleaning station 22.

The sheets (or, more broadly, substrates) on which images are desired to be printed are drawn from a stack 24 and brought into a "transfer zone" which, depending on a particular design of the apparatus, typically involves contact or proximity of the sheet with the surface of the photoreceptor 10, as well as suitable electric fields. The transfer station 20 includes apparatus for creating suitable conditions for the transfer zone.

Figure 2:
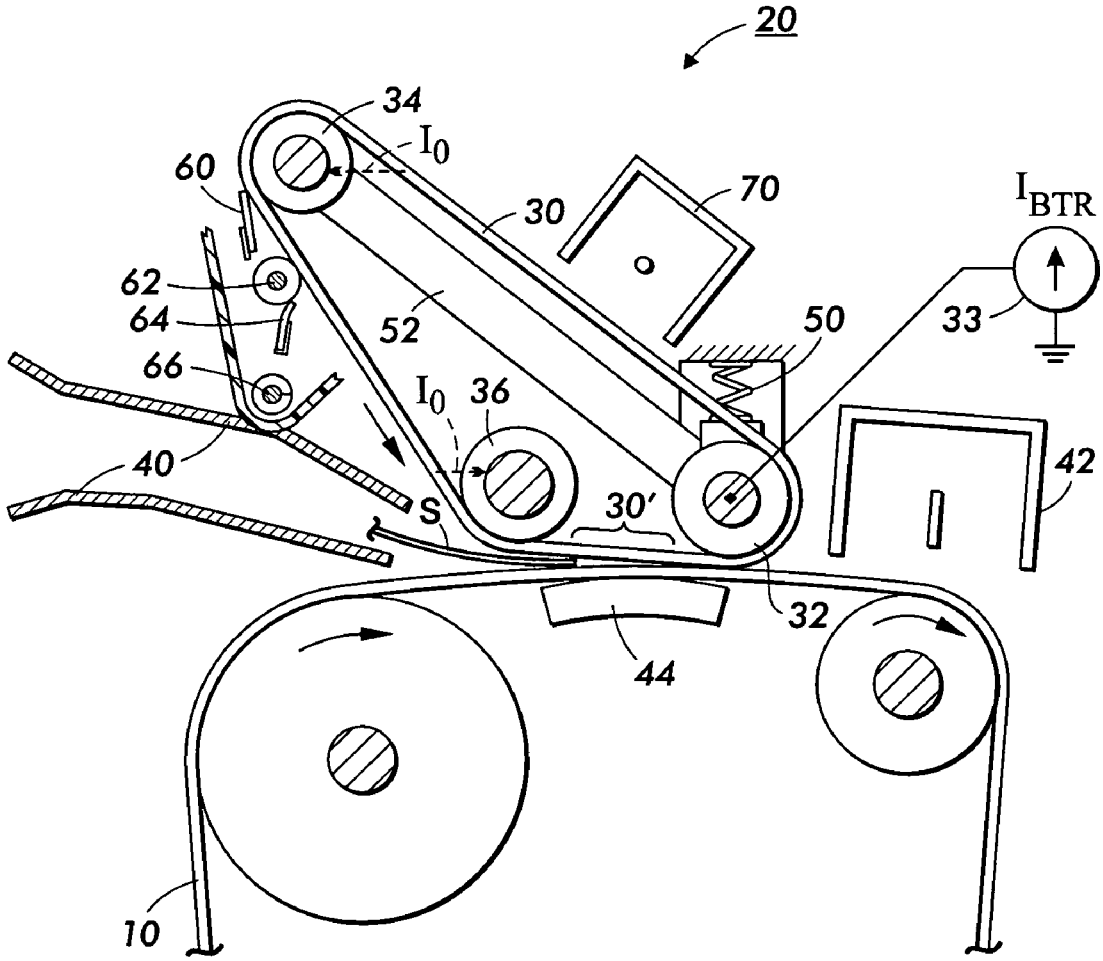
FIG. 2 is a detailed elevational view of one embodiment of a transfer station.

FIG. 2 is an elevational view showing one embodiment of transfer station 20 in detail. There is provided a transfer belt 30, which is rotatably entrained around, in this embodiment, a "transfer roll" 32, as well as a first carrier roll 34 and a second carrier roll 36. Transfer belt 30 is generally made of a substantially soft, flexible material, such as including rubber; it is also possible to provide a relatively stiff belt, comprising plastic. The transfer roll 32 is disposed to place a portion of the transfer belt 30 in contact with a portion of photoreceptor 10, thus, forming a nip between photoreceptor 10 and the portion of transfer belt 30. Transfer roll 32 typically comprises a bare metal shaft, or a metal shaft surrounded by a controlled-conductivity elastomer. In operation, as photoreceptor 10 is caused to move in a process direction as shown, the transfer belt 30 is caused to move in a rotation direction with the photoreceptor 10, with minimal slippage at the nip; this can be accomplished, in various designs, by having the transfer belt 30 ride passively with the motion of photoreceptor 10, or by having the transfer belt 30 to some extent be moved by an independent motor (not shown).

As shown in the Figure, an image-receiving substrate, such as a print sheet or substrate S, intended to receive a toner image from photoreceptor 10 passes through a baffle 40 and approaches the nip between photoreceptor 10 and transfer belt 30. At the nip itself, a toner image on the photoreceptor 10 is transferred to a print sheet passing between photoreceptor 10 and transfer belt 30 by a combination of physical pressure at the nip (caused at least in part by transfer roll 32) and an electrical bias placed on transfer roll 32 (such as by a contact and other circuitry, generally indicated as 33), which causes a suitable electric field to be established across the nip. This electric field can have AC and DC aspects.

As further shown in the Figure, the portion of transfer belt 30 corresponding to a position at the entrance of the nip (an "entry portion"), indicated as 30', forms a shallow angle with the adjacent portion of photoreceptor 10. This angle should be less than 30° and as shown can be less than 10°. With respect to the exit side of the nip (the "exit portion," on the right-hand side of transfer roll 32 in the Figure), the curvature and wrap angle of transfer belt 30 around transfer roll 32 should be such that the substrate S exiting the nip should be self-striping from the transfer belt 30. In practice, to ensure that the substrate does not adhere to the transfer belt 30, the angle formed between adjacent portions of transfer belt 30 and photoreceptor 10 is greater than 30°; as shown in the illustrated embodiment, the angle is greater than 90°. In other words, the total wrap angle of the transfer belt 30 around the circumference of transfer roll 32 is, in this embodiment, greater than 90°. In a practical embodiment, the diameter of transfer roll 32 is not more than 25 mm.

This configuration of the transfer roll 30 creates a transfer zone, the result of pressure and electric-field conditions, which is focused at the nip between transfer belt 30 and photoreceptor 10 made by the pressure of transfer roll 32. The "steep" angle of the transfer belt 30 immediately downstream of the nip is helpful in detacking the sheet or substrate S from the transfer belt 30 as the sheet exits the nip. To detack the sheet from the photoreceptor 10, there can further be provided a detack device, such as corotron 42, the general operation of which is known in the art: corotron 42 applies an electric charge to the sheet S, opposite to the charge previously deposited onto the sheet in the transfer zone. This reduces the net charge, and therefore reduces the electrostatic attraction between the sheet S and the portion of the photoreceptor 10 downstream of the nip.

Further as shown in FIG. 2, there is provided a spring 50, here in the form of a coil spring, and a mounting arm 52, which causes the transfer roll 32 to be urged against the photoreceptor 10 at the nip. If the photoreceptor 10 is in the form of a flexible belt, as in the Figure, then there can be provided a suitable backing member, such as skid 44, against which the transfer roll 32 can be urged.

In a practical application, to avoid marks caused by stray toner particles on the transfer belt 30 contacting the photoreceptor 10 or the back of a sheet, there is provided a cleaning system for the transfer belt 30. In the FIG. 2 embodiment, there is provided a cleaning blade 60 for mechanical removal of toner particles, as well as a electrically-biased cleaning roll 62 for electrostatic cleaning of the belt 30. The cleaning roll 62 (which is biased by external circuitry, not shown) is in turn mechanically cleaned by a cleaning blade 64, which may itself be electrically biased. Collected toner particles removed by either cleaning blade 60 or cleaning roll 62 are collected in a small hopper, where they may be conveyed out by an auger 66.

Figure 3:
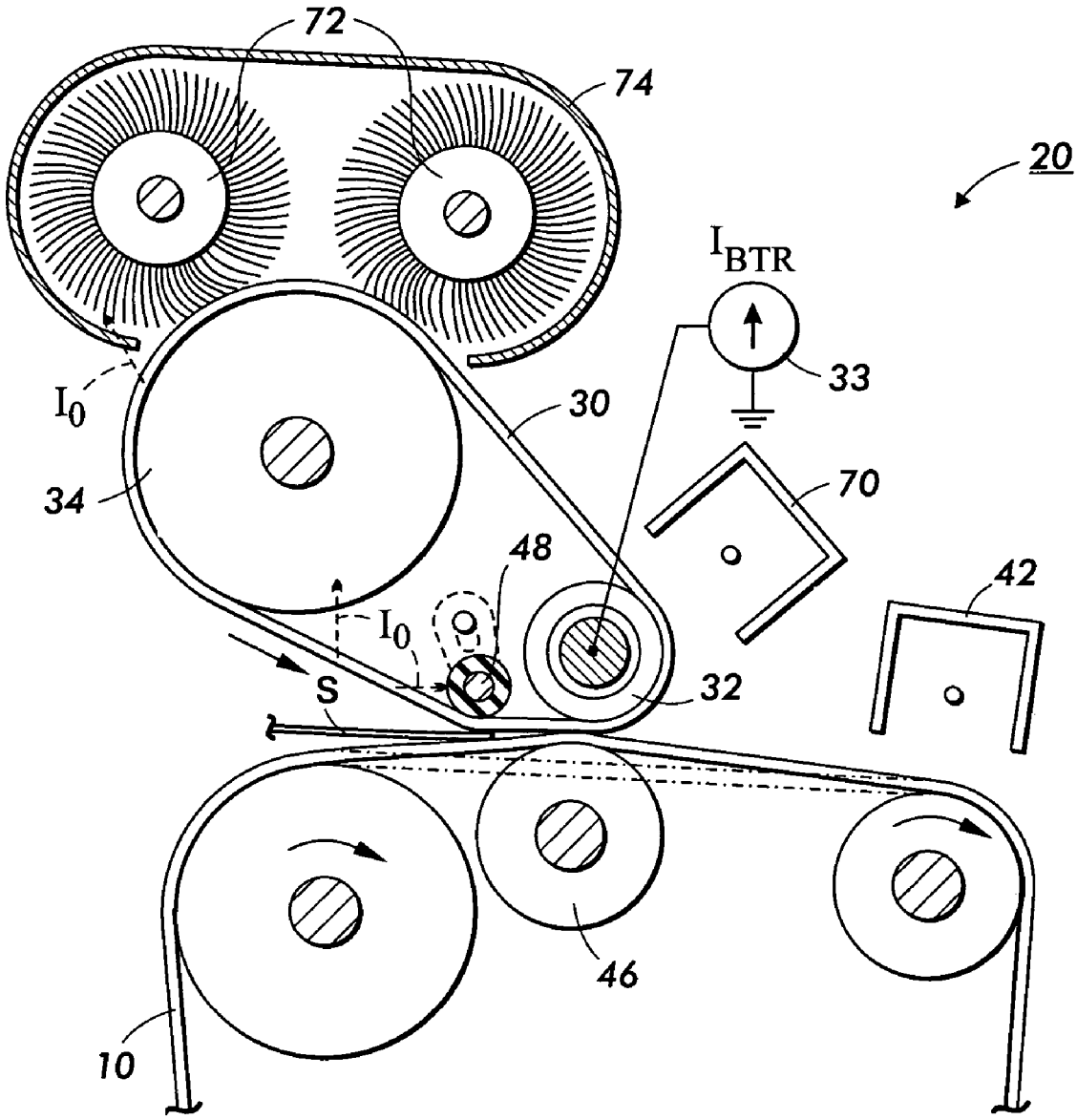
FIG. 3 is a detailed elevational view of another embodiment of a transfer station.

FIG. 3 is a detailed elevational view of another embodiment of a transfer station. In FIGS. 2 and 3, like reference numbers relate to like elements. As shown in FIG. 3, the transfer roll 32 is disposed through photoreceptor 10 against a backing roll 46. There is further provided a springably-mounted tension roller 48 (or more broadly a "tensioner," which may not include a roller), which maintains a desired tension on transfer belt 30. For purposes of cleaning the transfer belt 30, there is provided a cleaning corotron 70 (more broadly, a "source") that is directed at a portion of the transfer belt 30 downstream of the nip, as shown. The cleaning corotron 70 contributes to dislodging of toner particles that are adhering to the transfer belt 30. Further downstream of cleaning corotron 70 is a cleaning assembly, including two rotating brushes 72 in moving contact with a portion of the transfer belt 30, and which are in turn surrounded by a vacuum manifold 74, connected to a vacuum source (not shown), which removes toner or dirt particles from the brushes 72.

Figure 4:
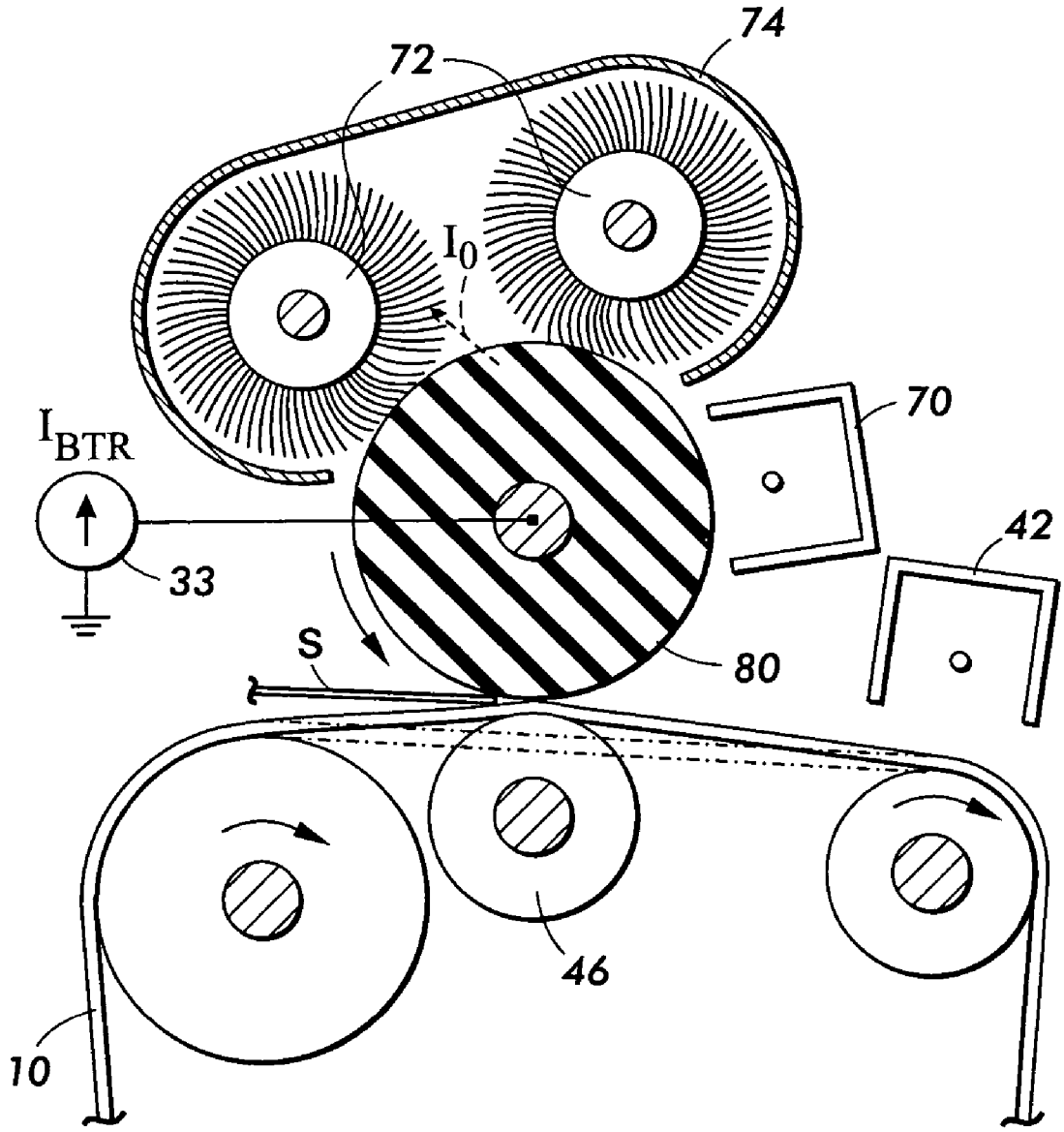
FIG. 4 is an elevational view of another embodiment of a transfer station.

FIG. 4 is an elevational view of another type of transfer station. In FIGS. 2 and 4, like reference numbers relate to like elements; however, in the FIG. 4 embodiment, instead of a transfer belt being entrained around a set of rollers, there is provided a single, solid transfer roll, indicated as 80. Transfer roller 80 generally acts in the manner of transfer belt 30 in the previously-described embodiments, including forming a transfer zone with photoreceptor 10, being cleaned by cleaning corotron 70 and rotating brushes 72.

Figure 5:
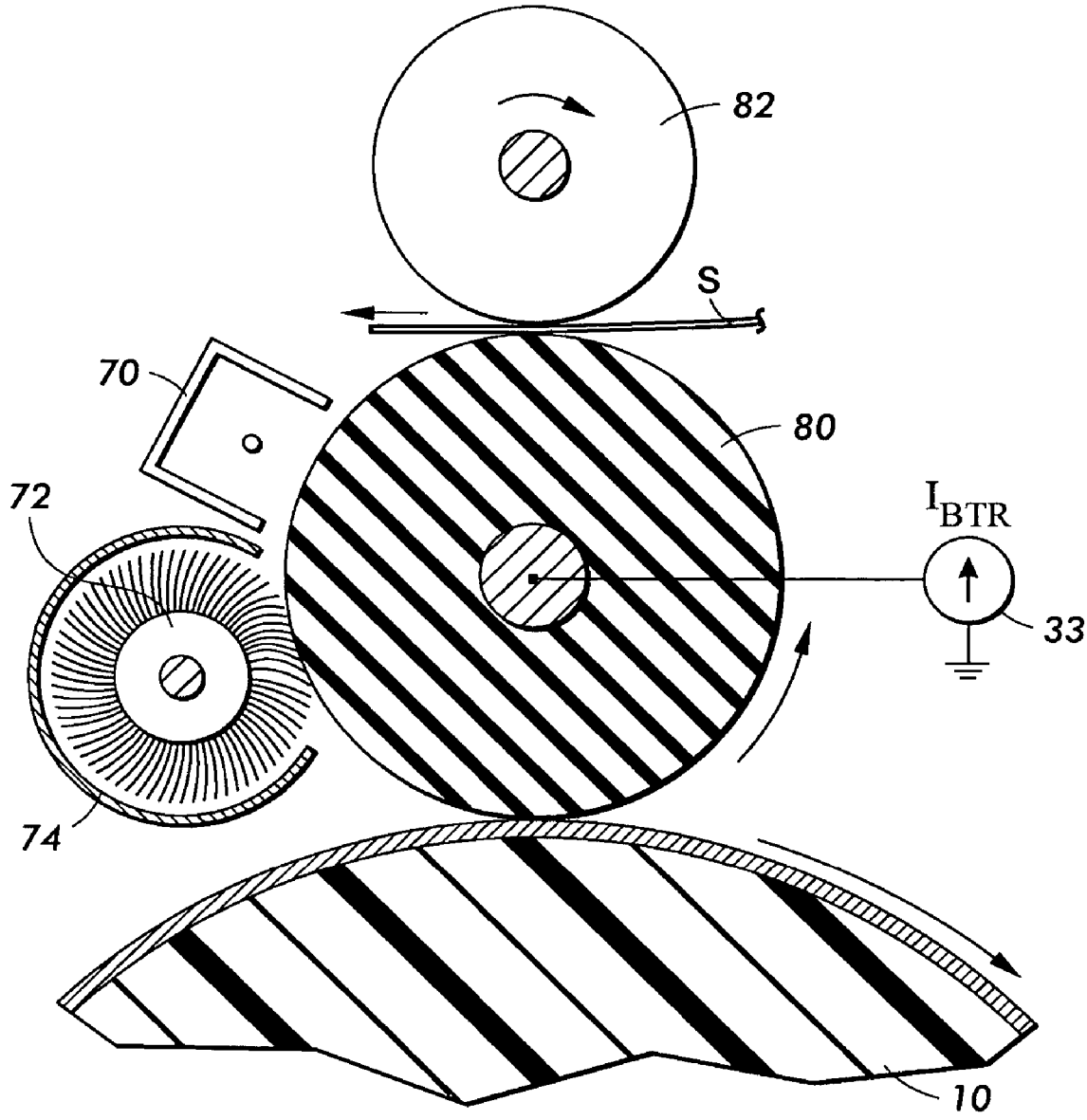
FIG. 5 is an elevational view of another embodiment of a transfer station.

FIG. 5 is an elevational view of another type of transfer station. In FIGS. 4 and 5, like reference numbers relate to like elements; however, in the FIG. 5 embodiment, the transfer roll 80 is used as an intermediate "blanket roll," which takes essentially all of a toner image from photoreceptor 10 and in turn transfers the toner image to a sheet S, typically with the aid of a second transfer roll 82. In the FIG. 5 embodiment, transfer roll 80 is in effectively constant contact with photoreceptor 10, as opposed to the previous embodiments, where the sheets S passes between the photoreceptor 10 and transfer roll 80. (In FIG. 5, the transfer point between transfer roll 80 and second transfer roll 82, through which sheet S passes, can be considered a second transfer zone; the means for creating this second transfer zone could include a second transfer roll 82, or some other equivalent generally known in the art for transferring toner, such as another corotron or a transfer belt.) Nonetheless, in FIG. 5, there is further associated with transfer roll 80 a cleaning corotron 70 and at least one brush 72 within vacuum manifold 74 the purpose of these elements is to ensure the surface of transfer roll 80 is clean before the surface re-contacts photoreceptor 10 to pick up another portion of a toner image.

In any of the above-described transfer stations, a control system for obtaining a desired field intensity in the transfer zone (between photoreceptor 10 and transfer belt 30 in the FIGS. 2 and 3 embodiments; or between photoreceptor 10 and transfer roll 80 in the FIG. 4 or FIG. 5 embodiments) must take into account, in addition to a bias placed on transfer roll 32 (in FIGS. 2 or 3) or transfer roll 80 (in FIG. 4 or 5) the cleaning corotron 70. The cleaning corotron 70 emits charge that will in effect detract from a bias or field created in the transfer zone. Further, the cleaning brushes 72 in any embodiment may affect the actual field strength in the transfer zone.

Also, in one practical application, an action of the cleaning corotron 70 is to deliver charge to the toner on transfer belt 30 (or equivalent). The cleaning brushes 72 are then more effective at cleaning the toner from the transfer belt 30. However, the toner intercepts only a fraction of the current on the transfer belt 30, and the rest flows through the transfer belt 30 to the transfer roll 32 and affects the field in the transfer zone.

In overview, a bias supplied by a power supply to obtain a constant current $I_{DYN}$ in the transfer zone would, in a basic case, require a current $I_{BTR}$ to be supplied to the transfer roll (30 or 80, depending on the embodiment). In an ideal case, with no cleaning experienced by the transfer roll, $I_{DYN}=I_{BTR}$. However, a current $I_{PC}$ simultaneously being supplied by the cleaning corotron 70 will to some extent cause a difference between the desired $I_{DYN}$ and the supplied $I_{BTR}$, and this difference can be expressed as $kI_{PC}$, with k being a long-term constant depending on the design of the transfer station and possibly ambient conditions, such as relative humidity. In addition, and in particular in the FIGS. 2 and 3 embodiments, any residual conductivity through the belt 30 itself may cause some current within the belt to be grounded through, for example, rolls 34, 36, or 48, or, in any embodiment, through the contact with the cleaning brushes 72; this grounding can cause a "leakage current" to ground which can be called $I_0$, which can be seen by the arrows indicated as $I_0$ in FIGS. 2, 3, and 4.

In summary, to obtain a desired dynamic current $I_{DYN}$ in the transfer zone, there must be supplied a current $I_{BTR}$ to transfer roll 32 or roll 80 such that $$I_{DYN}=I_{BTR}-I_0+kI_{PC}$$

In a practical control system, $I_{BTR}$ is controlled through a control system that will adjust $V_{BTR}$ in response to various conditions on a relatively short-term basis, such as in response to the entry of a sheet into the transfer zone, to maintain constant current drain at the transfer roll. The other values, $I_0$ and $kI_{PC}$, can typically be controlled on a relatively long-term (or slowly varying) basis, as they tend to be effected by long-term conditions such as relative humidity. A value of $I_0$ can be calculated at a cycle-up, such as by measuring a current drain through rolls 34, 36, or 48, as well as through brushes 72, both when the brushes are rotating and when they are still (and also taking into account, where applicable, any applied bias to the brushes 72). The value of $I_{PC}$ can be monitored as it is applied to cleaning corotron 70. To take a practical example, in a case where the cleaning corotron is set to $I_{PC}$=−20 uA, in order to apply negative charge to the toner that is to be removed from the transfer member, if the leakage current $I_0$ is =10 uA, k=1, and the desired $I_{DYN}$=100 uA, then $I_{BTR}$ must be set to 130 uA to insure the proper transfer field.

In the FIG. 5 embodiment, the bias applied to second transfer roll 82 can be taken into account as well, in a manner similar to that described in detail above. In such a case, the current flow to the second transfer roll 82 would simply contribute to $I_0$.

In the above descriptions of "corotrons," it will be understood that various types of field-creating devices can be contemplated under this term, such as pin- or wire-based devices, scorotrons, or any device that is useful to provide an electric current toward a surface for any purpose.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants, patentees, and others.

The invention claimed is:

1. An electrostatographic printing apparatus, comprising:
an imaging surface,
a rotatable transfer member, substantially in contact with the imaging surface at a transfer zone;
a control system for biasing the transfer member at the transfer zone;
an electrically biasable cleaning device associated with the transfer member;
the control system taking into account at least one of a current leakage or a bias associated with the cleaning device to obtain a desired electrical field at the transfer zone;
wherein the cleaning device includes a biasable cleaning corotron, associated with the transfer member; and
wherein the control system takes into account at least one of a current leakage or a bias associated with the cleaning corotron.

2. The apparatus of claim 1, wherein the rotatable transfer member includes a roll.

3. The apparatus of claim 1, wherein the rotatable transfer member includes a belt, and further comprising
a transfer roll, disposed adjacent the transfer zone, the rotatable transfer member being entrained on the transfer roll;
wherein the control system provides a predetermined bias to the transfer roll.

4. The apparatus of claim 1, further comprising
means for creating a second transfer zone, associated with the transfer member; and
wherein the control system takes into account at least one of a current leakage or a bias associated with the means for creating a second transfer zone.

5. The apparatus of claim 4, wherein the means for creating a second transfer zone includes a second transfer roll.

6. The apparatus of claim 1, wherein the control system adjusts a current in response to a current leakage on a long-term basis.

7. The apparatus of claim 1, wherein the control system adjusts a bias on a short-term basis.

8. The apparatus of claim 1, wherein the transfer zone accepts a substrate between the imaging surface and the transfer member.

* * * * *